US005337535A

United States Patent [19]

Maupin

[11] Patent Number: 5,337,535

[45] Date of Patent: Aug. 16, 1994

[54] PANEL SYSTEM AND METHOD FOR BUILDING CONSTRUCTION

[76] Inventor: James H. Maupin, P.O. Box 651, Franklin, Ky. 42135

[21] Appl. No.: 886,749

[22] Filed: May 20, 1992

[51] Int. Cl.[5] ..... E04G 21/14; E04B 2/72

[52] U.S. Cl. ..... 52/748; 52/262; 52/270; 52/293.3; 52/745.1

[58] Field of Search ..... 52/588, 284, 262, 264, 52/270, 293.3, 293.1, 478, 747, 748, 745.05, 745.09, 745.1, 745.13

[56] References Cited

U.S. PATENT DOCUMENTS

| | | | |
|---|---|---|---|
| 375,998 | 1/1888 | Hodges | 52/262 |
| 2,272,910 | 2/1942 | Gobberdiel | 52/262 |
| 3,343,314 | 9/1967 | Smith | 52/262 |
| 3,568,388 | 3/1971 | Flachbarth et al. | 52/588 |
| 3,626,649 | 12/1971 | Ohkawa . | |
| 3,744,208 | 7/1973 | Spanel | 52/706 |
| 3,952,461 | 4/1976 | Kinsey . | |
| 4,071,984 | 2/1978 | Larrow . | |
| 4,073,102 | 2/1978 | Fisher . | |
| 4,269,006 | 5/1981 | Larrow . | |
| 4,433,514 | 2/1984 | Henges, Jr. et al. | 52/262 |
| 4,464,877 | 8/1984 | Gebhardt et al. . | |

*Primary Examiner*—Michael Safavi
*Attorney, Agent, or Firm*—Mark J. Patterson; Edward D. Lanquist, Jr.; I. C. Waddey, Jr.

[57] ABSTRACT

The present invention discloses a panel system and method for building construction in which standing seam panels are attached to one another such that the inner flange of one panel attaches to the outer flange of an adjacent panel such that the tongue of the inner flange is received by the groove of the outer flange. Multiple panels are joined together to form wall, ceiling, and roof sections. Clips are used to secure wall sections to ceiling sections.

7 Claims, 6 Drawing Sheets

PANEL SYSTEM AND METHOD FOR BUILDING CONSTRUCTION

BACKGROUND OF THE INVENTION

The present invention relates generally to a system for building construction and more particularly to a panel construction system and method which uses conventional metal panels in place of wood studs, runners, and floor joists.

It will be appreciated by those skilled in the art that home builders and home buyers desire an efficient and inexpensive method of home and commercial building construction. Further, builders desire something which is easy to put together yet provides great strength. Building owners prefer a structure made out of materials which are not as susceptible to fire and insect invasion such as termites. To this end, there have been several attempts to provide a new system for home and building construction.

U.S. Pat. No. 4,327,529 issued to F. Bigelow, Jr., et al, on May 4, 1982 discloses a prefabricated building. However, although Bigelow discusses the use of prefabricated sections, Bigelow discloses no new types of building materials.

U. S. Pat. No. 4,005,941 issued to J. Laborde on Feb. 1, 1977, discloses a structural connection for runners and joists in which a piece of channel iron fits against the web of a piece of high beam. Although Laborde discloses a structural connection which is very effective for cross members, Laborde does not discuss a interweaving and interacting building system which can be used for rafters and studs.

U. S. Pat. No. 4,269,006 issued to K. Larrow on May 26, 1981, discloses a house assembly with prefabricated elements. Unfortunately, Larrow deals basically with prefabricated sections and uses existing materials to make these prefabricated elements. Larrow adds nothing to the art relating to studs.

U. S. Pat. No. 3,952,461 issued to L. Kinsey on Apr. 27, 1976, disclosed multi-layer walls that are frameless buildings. Unfortunately, Kinsey requires complex and puzzle-piece shaped studs which are complex to make and install.

U. S. Pat. No. 3,626,649 issued to Y. Ohkawa on Dec. 14, 1971 discloses a prefabricated house. Although Ohkawa does disclose various types of structural members, Ohkawa fails to disclose a new and useful type of interweaving metal system which can be used for studs.

What is needed, then, is a new construction system which uses components which easily fit together and which uses readily available, low cost construction panels. This needed method of construction must provide solid a solid structure which is not susceptible to insect penetration and less susceptible to fires than wood. This system must be easily adaptable for solid wall units, as well as window and door units. This method of construction is presently lacking in the prior art.

SUMMARY OF THE INVENTION

In the present device, a panel system for building construction is disclosed. The system consists of a series of interlocking panels which are, in the preferred embodiment, conventional 12"×4.5" standing seam panels which in the prior art have been used exclusively as roof panels. Each standing seam panel has a spine connected to an inner flange on one edge and an outer flange on its other edge. A tongue is connected to the inner flange whereas a sleeve is connected to the outer flange to provide a groove such that when plural panels are placed in alignment, the tongue of one panel can fit in the groove of a sleeve in an adjacent panel while its own groove receives the tongue of a panel on the other side.

Multiple panels are joined together in parallel alignment to form rising and level wall sections as well as ceiling or roof sections. Novel clip means connect wall sections to ceiling sections. A metal base channel is used to join the bottom of a wall section to the foundation. A metal top channel is used to join the exterior wall sections to the roof system. The ceiling panels can be angled to form an angled roof by merely making the panels different lengths. This system can be placed on a conventional foundation using standard floor joists.

Accordingly, one object of the present invention is to provide a system for building construction which uses conventional low cost metal panels as structural elements.

Still another object of the present invention is to provide a system for building construction which easily fits together.

Still another object of the present invention is to provide a construction which is structurally solid and not susceptible to insects and not as susceptible to fire as wood.

Still another object of the present invention is to provide a system for building construction which can be used for uninterrupted wall sections as well as wall sections having windows and doors.

BRIEF DESCRIPTION OF THE DRAWINGS

FIG. 7(*b*) is a top view of the door jamb.

DESCRIPTION OF THE PREFERRED EMBODIMENT

Figure 1:
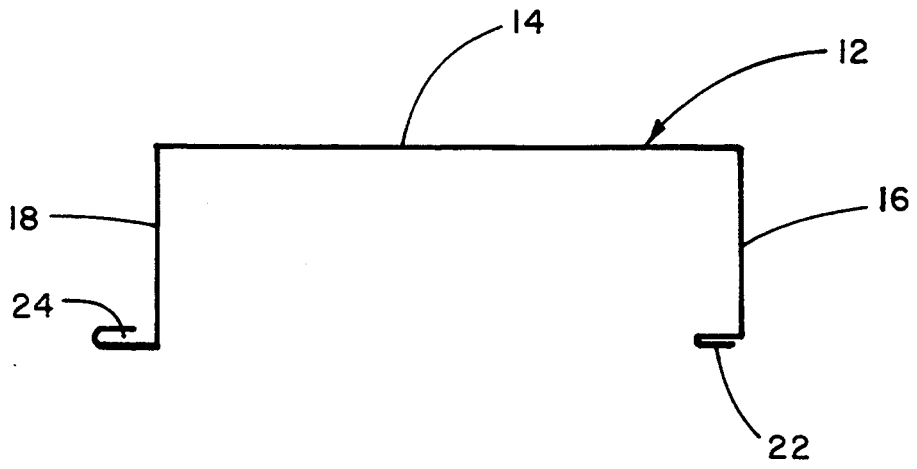
FIG. 1 is a top view of a single construction panel used in the system of the present invention.

Referring now to FIG. 1, there is shown generally at 12 the standing seam panel used in the panel construction system of the present invention. Panel 12, which preferably is a conventional 12" by 4.25" standing seam roof panel, is shaped from a single piece of sheet metal, preferably 24 gauge, to form spine section 14, inner flange 16, and outer flange 18. Outer flange 18 includes groove 20 which is formed by bending the metal at a right angle outwardly and away from flange 18 and then back toward inner flange 16 in the direction of spine 14, leaving a gap between the inner facing metal surfaces, thereby defining groove 24. Tongue 22 of inner flange 16 is formed by bending the metal sheet toward outer flange 18 at right angles, then back against itself toward flange 16 in a direction away from spine section 14. Groove 24 is sized and shaped to correspond to and easily receive tongue 22 of an adjacent panel 12. However, groove 24 and tongue 22 can be oriented in the opposite arrangement as long as tongue 22 fits within groove 24. Preferably, tongue 22 and groove 24 are approximately 1" wide.

Figure 2:
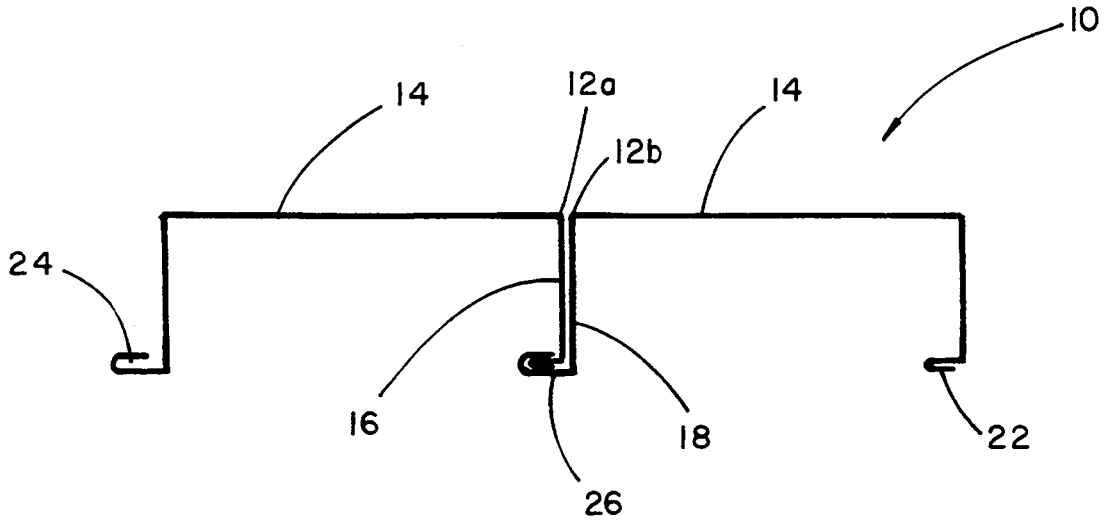
FIG. 2 is a top view showing two joined construction panels.

Referring now to FIG. 2, there is shown generally at 10 the joinder of two panels of the construction system of the present invention. Two panels **12*a* and 12*b* are placed adjacent to and in parallel alignment with one another. Tongue 22 of first panel 12*a* slides into and is received by groove 24 of second channel 12*b* to produce joint 26. Joint 26 cooperates with spine 14 to provide vertical structural support similar to that of a stud in a wall or the rafters of a roof. In the preferred embodiment, the outer surface of inner flange 16 of panel 12*a* is in contact with the outer surface of outer flange 18 of panel 12*b*. Further, the inner dimensions of groove 24 preferably closely correspond with the outer dimensions of tongue 22 so that sliding contact is made between them when two panels are assembled together, but with room remaining to accept the ceiling section attachment means described below. Consequently, joint 26** presents a surface to which sheetrock, paneling, or other interior wall materials can be screwed in conventional fashion.

Figure 3:
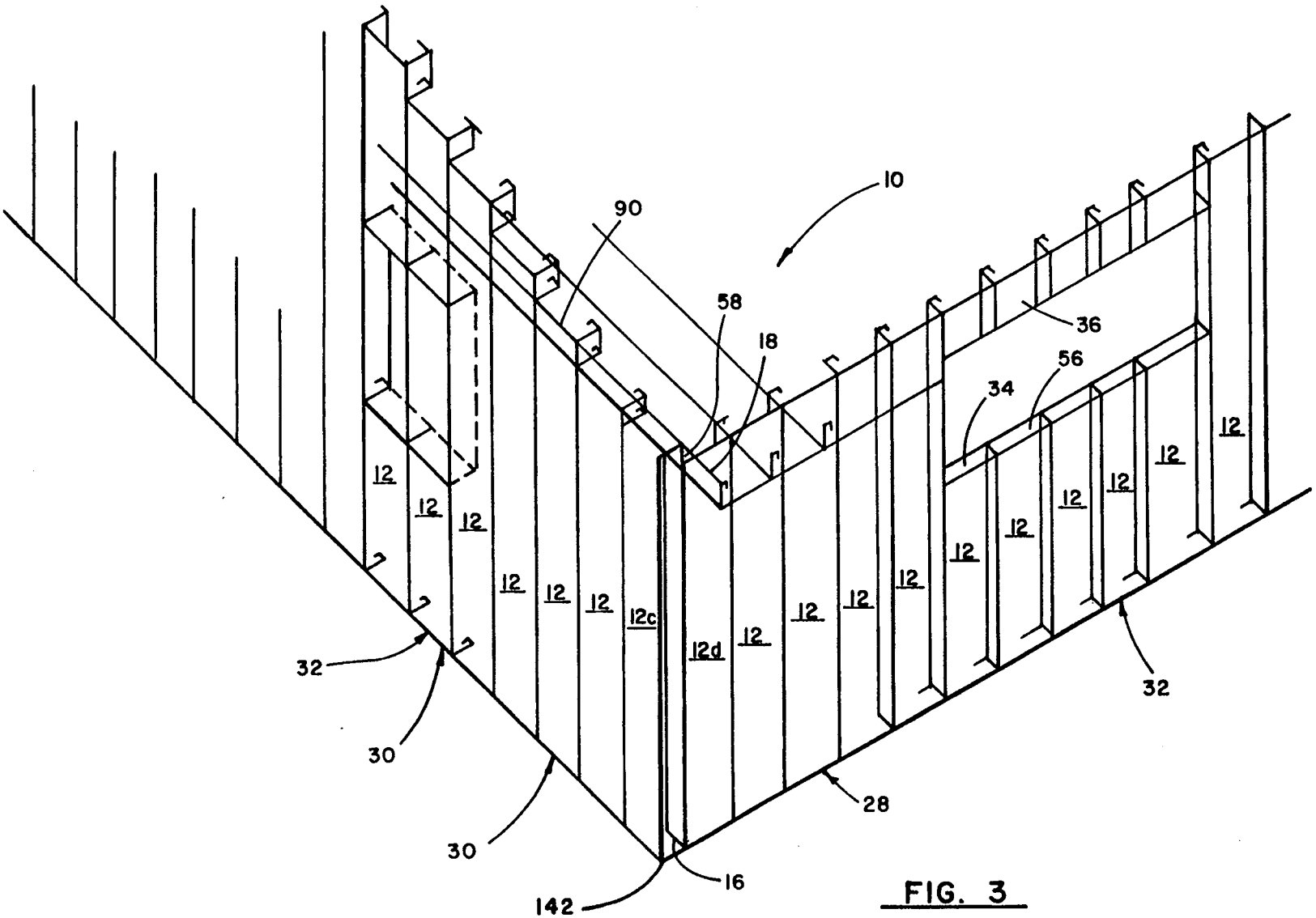
FIG. 3 is a perspective view showing the joinder of the multiple construction panels to form wall sections.

Referring now to FIG. 3, there is shown generally at 10 the panel construction system of the present invention in which multiple panels 12 are joined together in parallel alignment to form wall and window sections of the structure. To form level wall section 28, plural panels 12 of substantially the same length are joined to produce rising wall section 30. To form a rising wall section 30, such as an exterior wall supporting a pitched roof, multiple panels 12 of incrementally increasing length are joined. Further, multiple panels 12 can be joined to produce window wall section 32. Interior panels 12 of window section 32 are interrupted to define window opening 56. Window section 32 provides a level section for window jam 34 and header 36. A door frame is constructed in a similar manner except that there is no lower section of interior panels 12 beneath the door opening.

Corner section 58 is constructed such that corner panel **12*c* of rising wall section 30 forms the corner panel with its inner flange 16 exposed. End panel 12*d* attaches to corner panel 12*c* such that outer flange 18 of end panel 12*d* abuts inner flange 16 of corner panel 12*c***. By constructing the various wall sections of a structure using the system of the present invention, the sections can, if desired, for the most part be pre-assembled away from the building site from plans. This can result in substantial savings in time and material cost.

Figure 4:
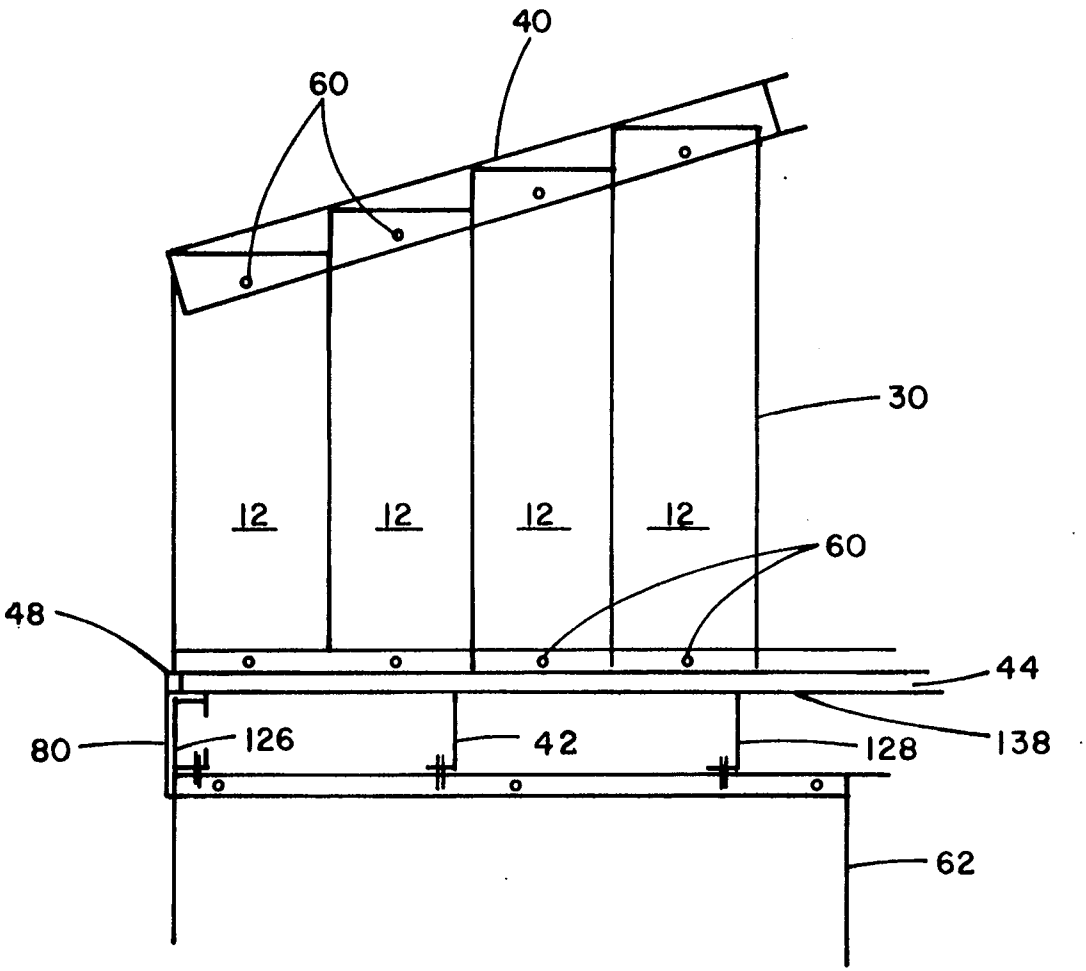
FIG. 4 is a side view showing the interconnection between rising wall panels, a floor system, and a sloped roof.
Figure 8:
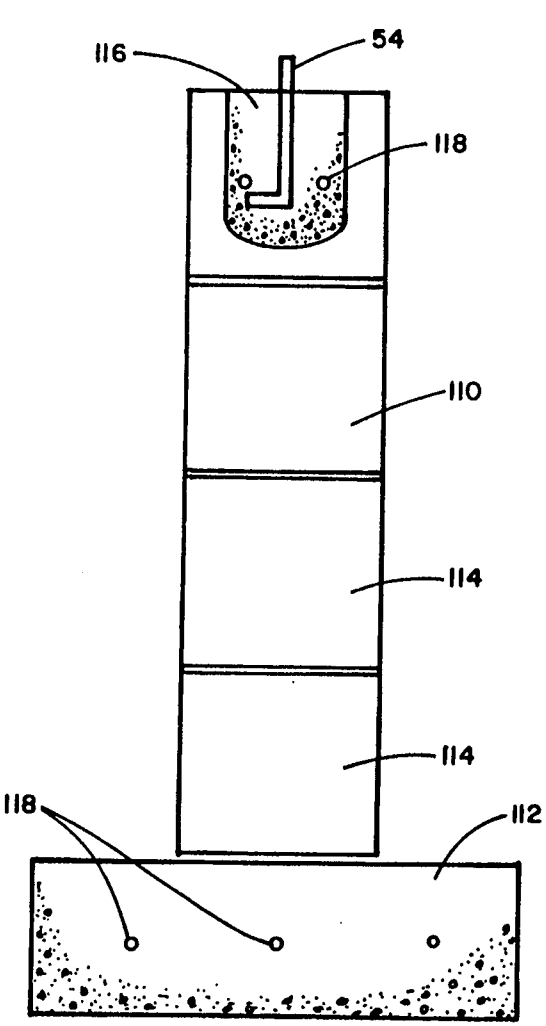
FIG. 8 is an end view showing the interaction between concrete bolts and foundation used in the system of the present invention.

Referring now to FIG. 4, there is shown a side view of the panel system of the present invention. An exterior rising wall section 30 is assembled by joining multiple panels 12, of different lengths, together. Along the top edge surfaces of panels 12 there is placed top channel 40. Top channel 40 attaches to panels 12 by means of screws 60. Base channel 48 receives the lower edge surfaces of panels 12. Panels 12 attach to base channel 48 by screws 60. Base channel 48 rests on foundation 62 through subflooring 44 and floor joists 42

Figure 5:
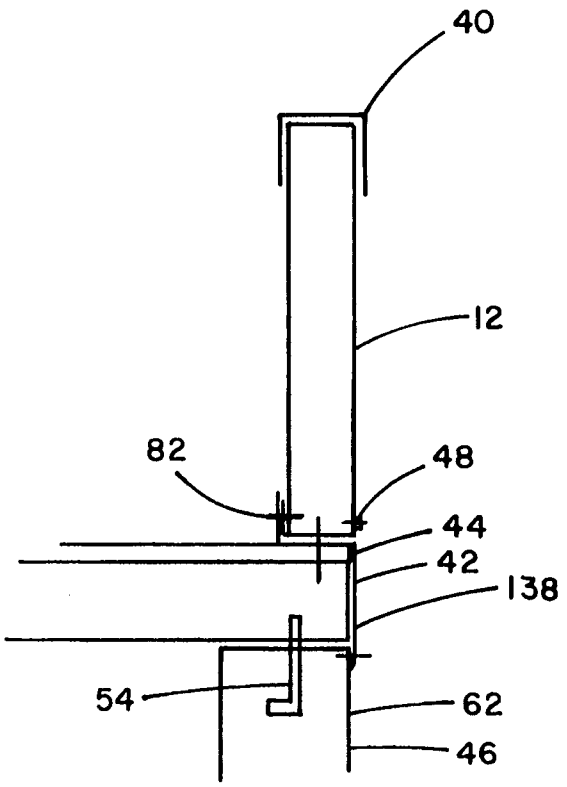
FIG. 5 is a cut-away end view of a level wall section interconnects with a floor system.

Referring now to FIG. 5, there is shown generally at 10 an end view of an exterior level wall erected using the panel system of the present invention. Each panel 12 is received by top channel 40 at the top and by base channel 48 at the bottom. Base channel 48 is attached to subflooring 44 which rests on floor joists 42. In the preferred embodiment, floor joists 42 are substantially eight inches from bottom to top. Floor joist 42 is secured to foundation 62, which in this embodiment is block 46, by anchor bolts 54. Top channel 40 is used as a surface to join the exterior wall sections to the roof system.

Figure 6:
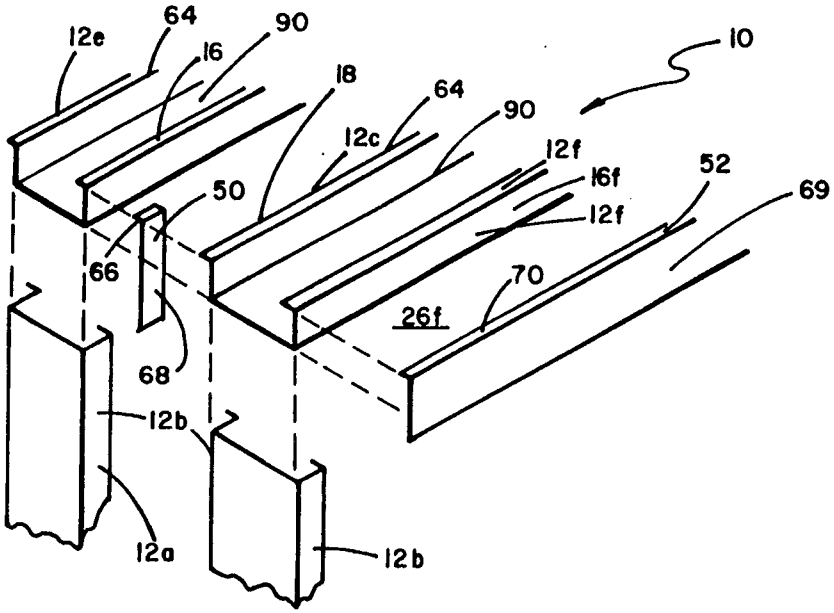
FIG. 6 is an exploded view showing the means of interconnection between wall sections and ceiling sections of the present invention.

Referring now to FIG. 6, there is shown generally at 10 an exploded view of the panel system of the present invention, showing the means of securing interior wall sections to multiple panels 12 which are joined as described above and oriented in the horizontal plane to form the ceiling or roof of the structure. In this exploded view, it is easy to visualize how multiple panels 12 in a wall section are joined together to interface with and receive horizontal ceiling panels **12*e* which, in this embodiment, act as rafters 64**.

The interior wall sections of the structure which run in a direction perpendicular to the rafters (panels) 64 are secured to rafters 64 by means of multiple perpendicular wall clips 50 which are positioned between inner flange 16 of ceiling panel **12*e* and outer flange 18 of adjacent panel 12*f*. Perpendicular wall clip 50 includes horizontal tab 66 bent at right angles to vertical member 68. Tab 66 of clip 50 is placed within joint 26 defined by the joinder of first panel 12*a* to second panel 12*b* in the manner described above. Similarly, vertical member 68 of clip 50 is aligned between and adjacent to the outer surfaces of inner flange 16 and outer flange 18 of adjacent panels which form rafters 64. The portion of vertical member 68 which extends below the ceiling section is positioned between the outer surfaces of the corresponding outer flange 18 and inner flange 16 of two joined panels 12*a* and 12*b* of the wall section below. Conventional sheet metal screws can then be used to secure the interconnection of the wall section to vertical member 68 of clip 50. Clip 50 in the preferred embodiment is a single piece of steel, with the vertical member being approximately 12" high by 3" wide and tab 66** being approximately ¾" by 3".

To join an interior wall section running parallel to rafters 64 to the ceiling, one places a longitudinal wall clip 52 along the inner flange **16*f* of desired ceiling panel 12*f*. Tab 70 of wall clip 52 is placed within joint 26*f* formed by the joinder of ceiling panel 12*f* with an adjacent panel (not shown). Vertical member 69 of wall clip 52 is aligned between the outer surfaces of inner flange 16*f* and the outer flange 18 of the adjacent panel. That portion of clip 52 which extends below the ceiling section can then be screwed in conventional fashion to the spine sections 14 (not shown) of the wall section below. In the preferred embodiment, longitudinal wall clip 52 is a single sheet of steel, with vertical member 69 being approximately 6" high and tab 70 being approximately ¾" wide. The length of clip 52** is cut to correspond to the desired length of its corresponding wall section.

By forming the ceiling or roof sections of the building as described above in the same manner as the wall sections, and as shown in FIG. 6, the interior of the structure is protected from water damage during construction immediately upon erection of the ceiling section.

Figure 7B:
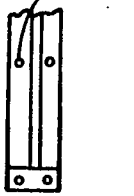
FIG. 7(*a*) is a perspective view of the door jamb of the present invention.
Figure 7A:
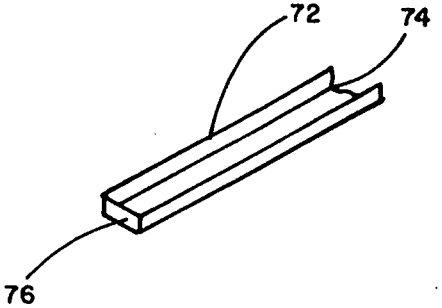
Figure 9:
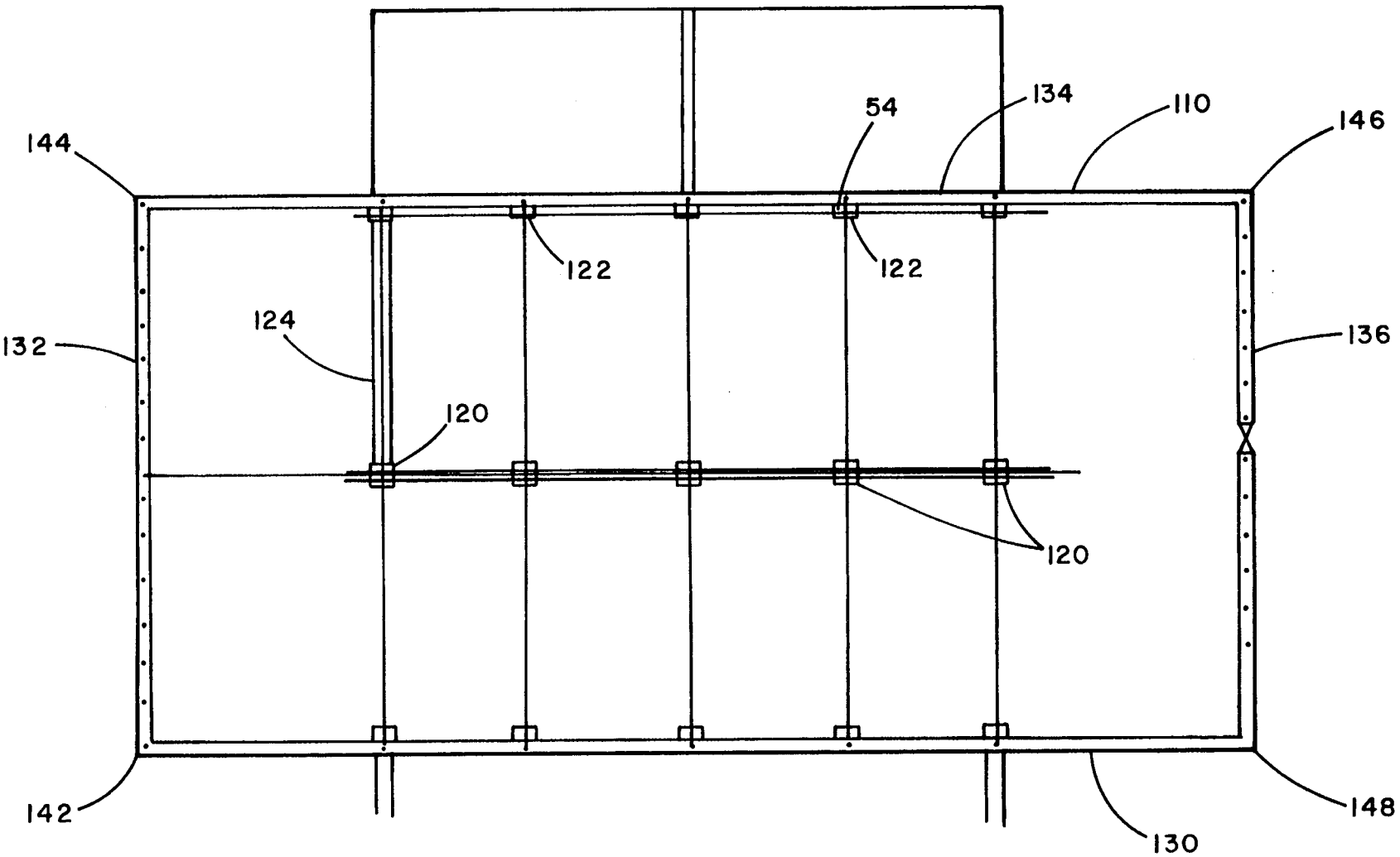
FIG. 9 is a plan view of a foundation used in conjunction with the system of the present invention.
Figure 11:
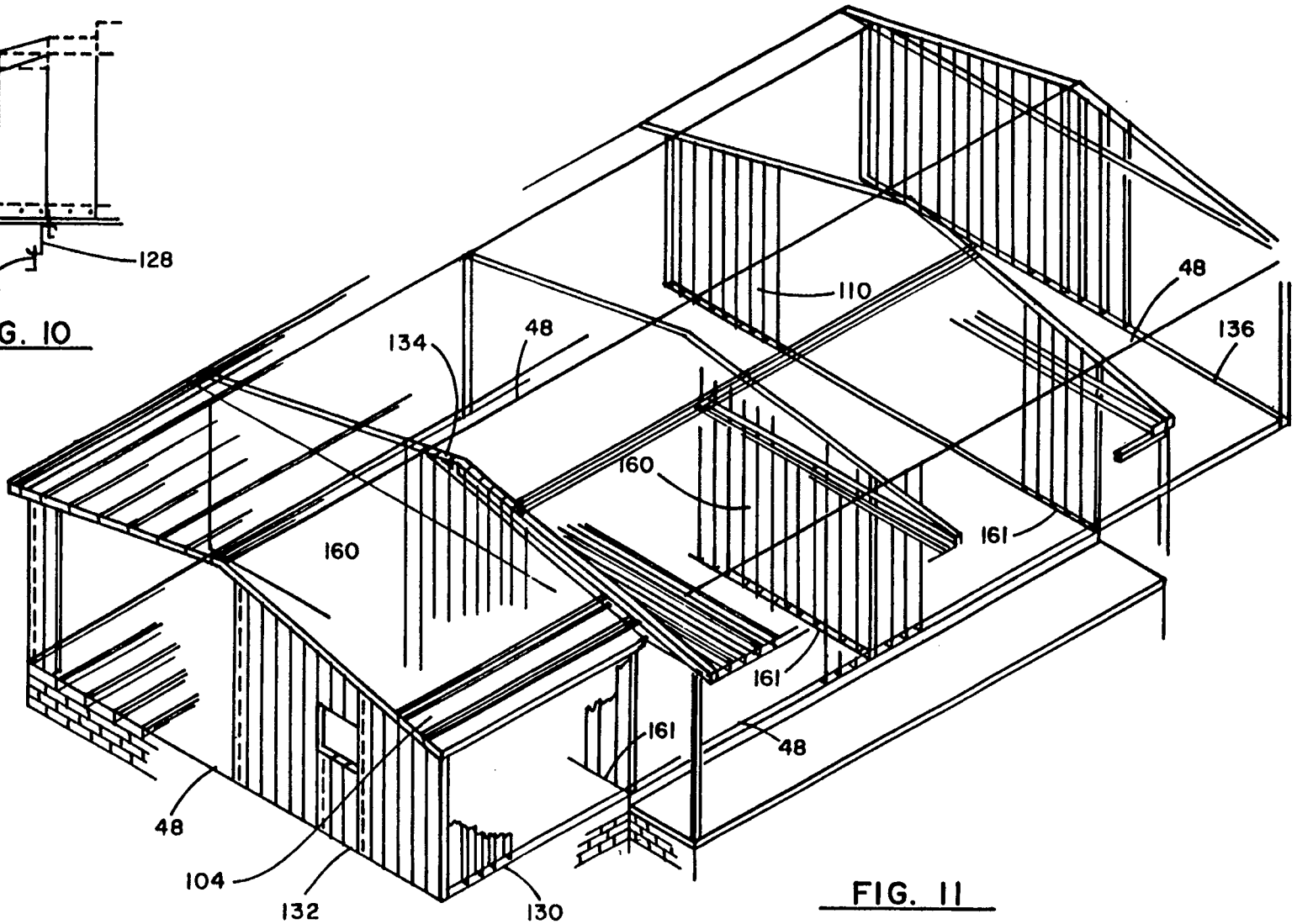
FIG. 11 is a partial cutaway view of the skeleton of a structure assembled in accordance with the method of the present invention.
Figure 10:
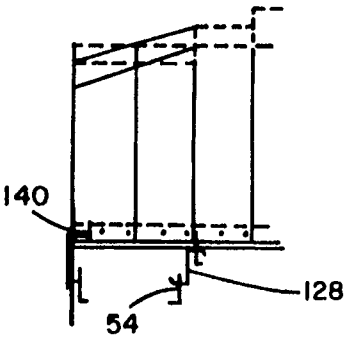
FIG. 10 is a cutaway end view showing the joist system of the present invention.

Referring now to FIGS. 7*a* and 7*b*, there is shown generally at 72 the door jamb of the present invention which is formed by bending a metal sheet into channel 74 as shown having end section 76. As can be seen in FIG. 7*b*, door jamb 72 is anchored to floor unit 78 by screws 80. The panel 12 which is adjacent to the door frame abuts end section 76 and can be screwed to end section 76 if desired. In the preferred embodiment, channel 74 of jamb 72 is substantially 2" wide. Also flange 70 of longitudinal wall clip 52 is preferably ¾" wide whereas interior wall clip 52 is preferably 6" tall.

Referring now to FIGS. 1–11, the method of construction using the panel system and method for building construction can be seen. Any conventional foundation can be used. In the preferred embodiment, standard block foundation 110 with blocks 114 placed on footer 112 poured on grade is used. Rebar 118 is used to reinforce footer 112 and top row of blocks 114. Concrete 116 is poured into top row of blocks 114 over rebar 118. Anchor bolt 54 is attached to block foundation 110 in top row of blocks 114 and the openings are filled with concrete 116. Center piers 120 and side piers 122 are provided on the interior of foundation 110. Piers 120, 122 are made of blocks 114 in standard fashion. Anchor bolts 54 are placed in each pier 120, 122, as they were placed in foundation 110. I-beams beams 124 run from front wall 130 to rear wall 134 and are attached to piers 120, 122 by bolts 54 which have been anchored to piers 120, 122.

Floor joists 42 are made of either C-girts 126 or Z-girts 128. Floor joists 42 run from left wall 132 to right wall 136 and are then attached to bolts 54 in foundation 110 and to I-beams 124. C-girts 126 are placed on top of front wall 130 and rear wall 134. Z-girts 128 are placed at the desired spacing in between C-girts 126. Insulation 138 is placed over floor joists 42. Sub-flooring 44 is placed over insulation 138. Either base angle 80 or base connector 138 is placed to cover ends of floor joists 42 along foundation walls 130, 132, 134, 136. Base connector 138 is base angle 80 with flange 140. Base angle 80 is secured to the foundation using 12–14×2 self-drilling screws with washers and concrete anchors.

Base channel 48 is placed around the outer perimeter of joists 42 with the flanges of channel 48 extending upwardly. If base connector 138 is used, the flange of channel 48 closest to the interior of the building abuts flange 140. Base channel 48 can be secured directly to the foundation if no joists are used using 12–14×2 self-drilling screws with washers and concrete anchors. Otherwise, channel 48 is secured to angle 80 or connector 138.

Starting at a corner 142 between front wall 130 and left wall 132, first panel section 150 is placed with spines 14 toward the exterior of the building. Section 150 is held plumb to insure straightness and proper alignment and attached to the outer flange of channel 48 with S-12 lathe head self driller screws (8×9/16). In the preferred embodiment, flange 82 extends substantially two inches from base 84 of channel 40. To start left wall 132 which extends away from the front wall 130 which is started by first panel section 150, second panel section 152 is placed in substantial perpendicular alignment with first section 150. Flanges 16, 18 of sections 150, 152 face away from corner 142. Flange 16 of panel 12 of section 150 closest to corner 142 abuts tongue 20 of panel 12 of section 152 closest to corner 142. Second section 152 is received by and secured to second base channel 48′ which is perpendicularly aligned to first base channel 48. Second section 152 attaches to second base channel 48′ in the manner discussed above between first panel section 150 and first base channel 48. In the preferred embodiment, self driller screws are placed every eighteen inches to secure first section 150 to second section 152.

Third panel section 154 is attached to first panel section 150 away from corner 142. Fourth section 156 is attached to second section 152 away from corner 142 using the tongue and groove connection discussed above between standing seam panels 12 leaving the upper eighteen inches clear to receive clip 50. A temporary brace such as a piece of two inch by two inch angle is used to brace the outermost panel while it is plumbed and secured to channel 48 as discussed above. Second corner 144 which joins left and rear walls 132, 134, is begun in the same manner as first corner 142. First ceiling panel 90, which is a standard standing seam panel 12, is attached along left wall 132 to bridge front and rear walls 130, 134 and is substantially parallel to channel 48′ at the height desired to set the buildings interior ceiling. Flange 92 is attached to studs formed by connection of panels 12 by use of screws or rivets. Two panel sections 158 are placed in the middle of the span of ceiling panel 90 to prevent it from sagging. The remaining panel sections 158 of left wall 132 can be added using ceiling panel 90 to assist the applier in orientation. Wall 132 is plumbed and ceiling panel 90 is checked to insure proper overhang. Clips 50 are placed at all connection points. Second ceiling panel 90′ is placed parallel to first ceiling panel 90 using the standing seam panel connection and clip 50 disclosed herein. The ends of ceiling panels 90, 90′ must be flush and the walls must be plumbed.

Driller screws are placed through ceiling panels 90 and clip 50 before four 8×⅝ screws are placed through side panels 12 and clips 50. Lock sealer 50 is used to lock ceiling panels 90, 90′ together. Self driller screws are placed through the side walls of two ceiling panels 90, 90′. More panel sections 158 are added along front and rear walls 130, 132 followed by more ceiling panels 90 in the same manner described above. Using the four existing ceiling panels 90 as a platform, vertical panels may be set in an end wall connecting first ceiling panel 90 to flange of first vertical panel 12. The vertical panels 12 will vary in length to form the pitch of the roof. Top channel 40, which is, in the preferred embodiment, 14 gauge steel, is placed over the tops of side panels 12 and end wall to form a surface to which roof purling can be attached.

Where windows and doors are involved, the correct length of panels 12 must be set in place. Header channel 36 and window seal 56 must be set in place. These must be leveled and locked in place using self driller screws. Front and rear walls 130, 134 are continued to be set in place with ceiling panels 90. Narrow clips 50 are used for interior cross walls with interior wall clips 52 being used for walls running in the same direction as the ceiling. Interior wall panels 100 are installed as ceiling panels 90 are installed.

Two one-and-one-half inch by two inch angles form interior wall channel 102 which is placed to receive interior vertical interior panels 100. Interior panels 100 are attached to angle 102 at floor and clip to ceiling panels 90 using clips 52. Interior panels 100 are fastened to one another with self driller screws every eighteen inches in the flange in the preferred embodiment. By placing angles 102 with one and one-half inches against the floor, this leaves an opening of approximately one and one-quarter inches for the electrical installer to get through without having to drill through the steel.

The installer should then preset cross wall partition panel base 161 to receive cross wall partitions 160. Partitions 160 can be taller than walls 130 or 132 to provide split-level roofs.

The installer should not sand front to back angles until the clips 50, 52, are in place in the ceiling and then plumb from clip to clip. When ceiling panels 90 are set in place, Z-girt should be placed on top side of the ceiling panels every eight feet from end wall to wall with attachment by twelve × one inch self driller screws every panel. The interior should be trimmed out on the stud side of the wall in a corner using two inch × two inch 20-gauge angles attached with lathe head self driller screws. Roof purlings 104 are set at twenty-four inches on center to adapt for either four × eight decking or standard steel roofing.

After the skeleton is completed, standard interior and exterior finishing can occur. Sheet rock or dry wall can be attached to all walls using self-tapping screws after interior insulation has been added. Exterior insulation can be added prior to placement of siding or brick.

Panel sections 158 can be prefabricated and numbered and consist of any number of panels 12. In the preferred embodiment, four panels 12 make section 158. Therefore, work can be done in a shop close to all of the machining equipment. On-site changes can be performed using metal snips.

Thus, although there have been described particular embodiments of the present invention, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A method of constructing a building having a perimeter, a foundation, subflooring, front, left, rear, and right walls, a first corner joining said front wall and said left wall, a second corner joining said left wall to said rear wall, a third corner joining said rear wall to said right wall, and a fourth corner joining said front wall to said right wall, said method comprising the steps of:

a. attaching to said perimeter of said building a first base channel along said front wall, a second base channel along said left wall, a third base channel along said rear wall, and a fourth base channel along said right wall;

b. attaching a first panel section to said second base channel along said left wall proximate to said first corner;

c. attaching a second panel section to said first base channel along said front wall proximate to said first corner such that said second panel abuts said first panel;

d. attaching a third panel section to said first panel section away from said first corner using tongue and groove connection wherein said groove comprises a first bend in said metal sheets at a right angle outwardly and away from said outer flange and a second bend toward said inner flange in direction of said spine leaving a gap between inner facing metal surfaces and said tongue comprises a tongue bend in said metal sheets toward said outer flange at right angles; and e. attaching a fourth panel section to said second panel section away from said first corner using tongue and groove connection wherein said groove comprises a first bend in said metal sheets at a right angle outwardly and away from said outer flange and a second bend toward said inner flange in direction of said spine leaving a gap between inner facing metal surfaces and said tongue comprises a tongue bend in said metal sheets toward said outer flange at right angles.

2. The method of claim 1 further comprising the steps of:

a. attaching a fifth panel section to said second base channel along said left wall proximate to said second corner;

b. attaching a sixth panel section to said third base channel along said rear wall proximate to said third corner such that said sixth panel abuts said fifth panel;

c. attaching a seventh panel section to said fifth panel section away from said second corner using tongue and groove connection;

d. attaching an eighth panel section to said sixth panel section away from said second corner using tongue and groove connection; and e. attaching panel sections using tongue and groove connection until one of said walls between said first corner and said second corner is completed.

3. The method of claim 2 further comprising the steps of:

a. attaching a first ceiling panel having a first end and a second end, said first ceiling panel running along said second wall and attached to said front wall at said first end and said rear wall at said second end; and b. attaching a second ceiling panel to said first ceiling panel using tongue and groove connection away from said left wall.

4. The method of claim 3 further comprising the step of adding corresponding panel sections to said front wall and said rear wall.

5. The method of claim 4 further comprising the step of attaching ceiling panels to said added corresponding panel sections.

6. The method of claim 5 further comprising constructing a fourth end from panel sections.

7. A method of erecting a structure having a foundation, wall sections and roof sections comprising the steps of:

a. joining two or more standing seam metal panels, each of said panels having an outer flange defining a groove along one edge, and an inner flange defining a tongue along an opposite edge, by interlocking said tongue of one of said panels with said groove of an adjacent said panel, said joined panels thereby defining said wall section or said roof section wherein said groove has two bends which create a gap between inner facing metal surfaces and said tongue has a tongue bend toward said outer flange at right angles;

b. erecting said wall sections vertically from said foundation by attaching the bottom of said wall sections of said foundation using a metal channel; and c. attaching a ceiling panel horizontally to the top of said wall sections using metal clip means.

* * * * *